US009820038B2

(12) United States Patent
Salvatti et al.

(10) Patent No.: US 9,820,038 B2
(45) Date of Patent: Nov. 14, 2017

(54) WATERPROOF SPEAKER MODULE

(71) Applicant: Apple Inc., Cupertino, CA (US)

(72) Inventors: Alexander V. Salvatti, Cupertino, CA (US); Andrew Bright, San Francisco, CA (US); Christopher Wilk, Cupertino, CA (US); Justin D. Crosby, Cupertino, CA (US); Nikolas T. Vitt, Cupertino, CA (US); Pablo Seoane Vieites, Cupertino, CA (US); Ruchir M. Dave, Cupertino, CA (US); Samuel Bruce Weiss, Los Altos, CA (US); Teemu P. Sipila, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/025,328

(22) PCT Filed: Sep. 30, 2013

(86) PCT No.: PCT/US2013/062696
§ 371 (c)(1),
(2) Date: Mar. 28, 2016

(87) PCT Pub. No.: WO2015/047410
PCT Pub. Date: Apr. 2, 2015

(65) Prior Publication Data

US 2016/0212526 A1 Jul. 21, 2016

(51) Int. Cl.

| | |
|---|---|
| ***H04R 9/06*** | (2006.01) |
| ***H04R 1/44*** | (2006.01) |
| ***H04R 1/02*** | (2006.01) |

(52) U.S. Cl.
CPC ..... *H04R 1/44* (2013.01); *H04R 1/026* (2013.01); *H04R 9/06* (2013.01)

(58) Field of Classification Search
CPC ..... H04R 1/44; H04R 2307/201; H04R 2307/207
See application file for complete search history.

(56) References Cited

U.S. PATENT DOCUMENTS 3,987,258 A 10/1976 Tsutsui
4,868,799 A * 9/1989 Massa ..... H04R 1/44 367/172

(Continued)

FOREIGN PATENT DOCUMENTS

CN 1642355 7/2005
CN 1933679 3/2007

(Continued)

OTHER PUBLICATIONS

U.S. Appl. No. 14/448,387, filed Jul. 31, 2014, Lippert et al.

(Continued)

*Primary Examiner* — Curtis Kuntz
*Assistant Examiner* — Ryan Robinson
(74) *Attorney, Agent, or Firm* — Brownstein Hyatt Farber Schreck, LLP

(57) ABSTRACT

A waterproof speaker module may include a membrane formed from at least one waterproof and elastic material and a supporting structure. The membrane may include an outer surface, an inner surface, and at least one concave region that is indented toward the inner surface. The supporting structure may be coupled to the membrane and include a support structure that mates with the concave region of the membrane when the speaker is subjected to a hydrostatic load. When the speaker is not subjected to a hydrostatic load, the support structure may contact the concave region. In this way, the membrane may be resistant to tearing or rupture due to hydrostatic load.

26 Claims, 9 Drawing Sheets

(56) References Cited

U.S. PATENT DOCUMENTS

| | | | | |
|---|---|---|---|---|
| 5,117,403 | A * | 5/1992 | Eberl | H04R 1/44 367/175 |
| 5,349,140 | A | 9/1994 | Valenzin | |
| 5,812,496 | A | 9/1998 | Peck | |
| 6,007,105 | A | 12/1999 | Dietle et al. | |
| 6,064,909 | A | 5/2000 | Barkley et al. | |
| 6,128,394 | A | 10/2000 | Hayakawa | |
| 6,486,398 | B1 | 11/2002 | McCulloch | |
| 6,785,395 | B1 | 8/2004 | Ameson | |
| 6,899,794 | B1 | 5/2005 | Yamada | |
| 6,932,187 | B2 | 8/2005 | Banter et al. | |
| 7,245,733 | B2 | 7/2007 | Saltykov | |
| 7,480,209 | B2 * | 1/2009 | Giles | H04R 1/44 367/174 |
| 7,499,561 | B2 | 3/2009 | Hanses et al. | |
| 7,577,345 | B2 | 8/2009 | Tei et al. | |
| 7,707,877 | B2 | 5/2010 | Nishizu et al. | |
| 7,876,919 | B2 | 1/2011 | Ram et al. | |
| 7,894,621 | B2 | 2/2011 | Jensen | |
| 8,055,003 | B2 | 11/2011 | Mittleman et al. | |
| 8,059,490 | B2 | 11/2011 | Rapps et al. | |
| 8,112,130 | B2 | 2/2012 | Mittleman et al. | |
| 8,135,149 | B2 | 3/2012 | Yoshida et al. | |
| 8,157,048 | B2 | 4/2012 | Banter et al. | |
| 8,170,266 | B2 | 5/2012 | Hopkinson et al. | |
| 8,175,321 | B2 | 5/2012 | Bryant et al. | |
| 8,185,166 | B2 | 5/2012 | Weber et al. | |
| 8,220,142 | B2 | 7/2012 | Lim | |
| 8,229,153 | B2 | 7/2012 | Mittleman et al. | |
| 8,233,646 | B2 * | 7/2012 | Lutz | H04R 7/18 381/150 |
| 8,272,517 | B2 | 9/2012 | Horie et al. | |
| 8,416,089 | B1 | 4/2013 | Clary | |
| 8,638,970 | B2 | 1/2014 | Burton | |
| 8,644,530 | B2 | 2/2014 | Soininen et al. | |
| 8,670,586 | B1 | 3/2014 | Boyle et al. | |
| 8,687,828 | B2 | 4/2014 | Otani et al. | |
| 8,724,841 | B2 | 5/2014 | Bright et al. | |
| 8,792,665 | B2 | 7/2014 | Lin | |
| 8,803,745 | B2 | 8/2014 | Dabov | |
| 8,811,634 | B2 | 8/2014 | Kaplan et al. | |
| 8,883,289 | B2 | 11/2014 | Tsao et al. | |
| 8,923,528 | B2 | 12/2014 | Arche | |
| 8,939,252 | B2 | 1/2015 | Sanborn | |
| 8,942,401 | B2 | 1/2015 | Murayama | |
| 8,965,030 | B2 | 2/2015 | Aase | |
| 8,986,802 | B2 | 3/2015 | Karube et al. | |
| 9,038,773 | B2 | 5/2015 | Banter | |
| 9,078,063 | B2 | 7/2015 | Loeppert et al. | |
| 9,132,270 | B2 | 9/2015 | Vaishya | |
| 9,171,535 | B2 | 10/2015 | Abe et al. | |
| 9,226,076 | B2 | 12/2015 | Lippert et al. | |
| 9,253,297 | B2 | 2/2016 | Abe et al. | |
| 9,363,589 | B2 | 6/2016 | Lippert et al. | |
| 2004/0029530 | A1 | 2/2004 | Noguchi et al. | |
| 2005/0134473 | A1 | 6/2005 | Jang et al. | |
| 2006/0045301 | A1 | 3/2006 | Jakubaitis | |
| 2006/0198547 | A1 | 9/2006 | Hampton | |
| 2007/0003081 | A1 | 1/2007 | Ram et al. | |
| 2007/0035865 | A1 | 2/2007 | Chashi | |
| 2007/0113964 | A1 | 5/2007 | Crawford et al. | |
| 2007/0263878 | A1 | 11/2007 | Yu | |
| 2008/0149417 | A1 | 6/2008 | Dinh | |
| 2009/0230487 | A1 | 9/2009 | Saitoh et al. | |
| 2011/0013799 | A1 | 1/2011 | Fang et al. | |
| 2011/0298184 | A1 | 12/2011 | Aurelius | |
| 2011/0317868 | A1 * | 12/2011 | Tsujii | H04R 7/16 381/400 |
| 2012/0177239 | A1 | 7/2012 | Lee | |
| 2012/0195455 | A1 | 8/2012 | Chiba et al. | |
| 2013/0170109 | A1 | 7/2013 | Cohen et al. | |
| 2013/0287213 | A1 | 10/2013 | Sekiyama | |
| 2013/0296994 | A1 | 11/2013 | Vaishya | |
| 2014/0044297 | A1 | 2/2014 | Loeppert et al. | |
| 2014/0064546 | A1 | 3/2014 | Szczech | |
| 2014/0083296 | A1 | 3/2014 | Sanders | |
| 2014/0093095 | A1 | 4/2014 | Slotte et al. | |
| 2014/0219646 | A1 | 8/2014 | Hooton et al. | |
| 2014/0254849 | A1 | 9/2014 | Abe et al. | |
| 2014/0369547 | A1 * | 12/2014 | Qingshan | H04R 7/20 381/398 |
| 2015/0016648 | A1 | 1/2015 | Kazemzadeh et al. | |
| 2015/0146905 | A1 | 5/2015 | Abe et al. | |
| 2015/0163572 | A1 | 6/2015 | Weiss et al. | |
| 2015/0237431 | A1 | 8/2015 | Jeziorek et al. | |
| 2015/0304767 | A1 | 10/2015 | Mori | |
| 2015/0319534 | A1 | 11/2015 | Lippert et al. | |
| 2016/0205469 | A1 * | 7/2016 | Steijner | H04R 1/44 381/334 |
| 2017/0041712 | A1 | 2/2017 | Lippert et al. | |

FOREIGN PATENT DOCUMENTS

| | | | | |
|---|---|---|---|---|
| DE | 1079664 | A2 * | 2/2001 | H04R 9/066 |
| EP | 1998591 | | 12/2008 | |
| JP | WO 2004043113 | A1 * | 5/2004 | H04R 9/10 |
| JP | 2004312156 | | 11/2004 | |
| JP | 2011188191 | | 9/2011 | |
| JP | WO 2011125804 | A1 * | 10/2011 | H04R 9/06 |
| JP | 2013115549 | | 6/2013 | |
| WO | WO 2004/043113 | | 5/2004 | |
| WO | WO 2011/125804 | | 10/2011 | |
| WO | WO 2015/047378 | | 4/2015 | |

OTHER PUBLICATIONS

U.S. Appl. No. 14/498,221, filed Sep. 26, 2014, Lippert et al.
U.S. Appl. No. 14/563,454, filed Dec. 8, 2014, Lippert et al.
U.S. Appl. No. 14/747,642, filed Jun. 23, 2015, Cardinali et al.
International Search Report and Written Opinion dated Jun. 2, 2014, PCT/US2013/062696, 10 pages.
Consumerist, "Cellphone Battery Designed To Fail At First Drop Of Water?" Consumerist, Sep. 22, 2007 (Sep. 22, 2007), XP055199652, Retrieved from the Internet: URL:http://consumerist.com/2007/09/22/cellphone-battery-designed-to-fail-at-first-drop-of-water/ [retrieved on Jul. 2, 2015], 4 pages.
The Gadget Show, "What to do when gadgets get wet," Retrieved from the Internet: URL:http://gadgetshow.channel5.com/gadget-show/blog/what-to-do-when-gadgets-get-wet [retrieved on Apr. 9, 2014], p. 2, paragraph 1, 2 pages.
Nakano et al., "Helmholtz resonance technique for measuring liquid vols. under micro-gravity conditions," Microgravity Sci. Technol., XVII-3, 2005, pp. 64-70.

* cited by examiner

WATERPROOF SPEAKER MODULE

CROSS REFERENCE TO RELATED APPLICATION

This application is a 35 U.S.C. §371 application of PCT/US2013/062696, filed on Sep. 30, 2013, and entitled "Waterproof Speaker Module," which is incorporated by reference as if fully disclosed herein.

TECHNICAL FIELD

This disclosure relates generally to electroacoustic transducers, and more specifically to waterproof speaker modules.

BACKGROUND

Electroacoustic transducers, such as speaker modules, are typically vulnerable to damage from water. Some speakers may utilize seals to prevent water from reaching and thereby damaging sensitive speaker components and may be referred to as "waterproof." However, no speaker is truly waterproof. Even when seals are utilized, speaker components may be vulnerable to sufficient hydrostatic load exerted upon speaker components when the speakers are immersed in water at depth. As such, referencing a speaker as waterproof may mean that the speaker is water resistant up to a particular hydrostatic load exerted by a particular depth of water (such as twelve feet).

For example, excessive hydrostatic load may cause the membrane of the speaker to tear, rupture or otherwise experience damage. Even if the speaker includes seals to keep out water, tearing or rupture of the speaker membrane may cause the speaker to no longer function and/or may enable water to reach and thereby damage other speaker components.

SUMMARY

The present disclosure discloses apparatuses and methods for "waterproof" (i.e., waterproof or water resistant) speaker modules. A speaker module may include a membrane formed from at least one waterproof and elastic material and a supporting structure. The membrane may include an outer surface, an inner surface, and at least one inwardly-extending region that is indented toward the inner surface. The supporting structure may be coupled to the membrane and include a support structure that mates with the concave region of the membrane when the speaker is subjected to a hydrostatic load. In various implementations, the support structure may be shaped to correspond with a shape of the concave region. In this way, the membrane may be resistant to tearing or rupture due to hydrostatic load.

In some cases, the waterproof speaker module may be incorporated into an electronic device such as a desktop computer, a laptop computer, a cellular telephone, a personal digital assistant, a mobile computer, a tablet computer, a digital media player, a wearable device, a smart phone, a display device, a television, a kitchen appliance, and/or any other electronic device.

In some implementations, the speaker module may utilize magnetic flux during operation (though in other implementations the speaker module may utilize other mechanisms for operation such as a piezoelectric speaker mechanism). In such an implementation, the supporting structure may be formed of a magnetic material (such as stainless steel) and may aid in the direction of the magnetic flux utilized for speaker module operation. Additionally in such implementations, a lid member may be attached to the top of a center magnet. Such a lid member may be operable to resist downward motion of the membrane and further aid in resistance of the membrane to tearing or rupture when subjected to hydrostatic load.

In one or more implementations, the membrane may include a stiffening structure coupled to at least a portion of the outer surface and/or the inner surface. As the membrane is made of an elastic material, the membrane may not be as sensitive to movement of the voice coil as membranes made of less elastic materials. The stiffening structure may be made of a rigid material and as such may assist in vibration of the membrane. In some implementations, the speaker module may include one or more catch mechanisms that are operable to restrict movement of the membrane away from internal portions of the speaker module to prevent internal pressure of the speaker module from tearing or rupturing the module.

In one or more implementations, the speaker module may not be hermetically sealed. As the speaker module may not be hermetically sealed, internal pressure of the speaker may be able to escape and may not cause the membrane to rupture or tear. In implementations where the speaker module is hermetically sealed, the speaker module may include a mechanism for releasing internal pressure of the speaker module when the internal pressure of the speaker module exceeds barometric pressure of the environment of the speaker module.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

Figure 1:
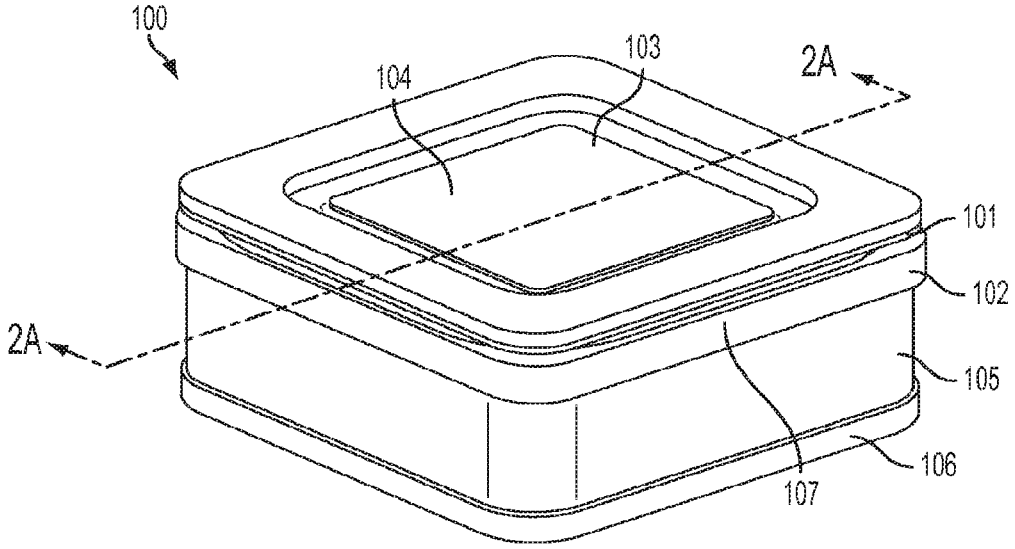
FIG. 1 is an isometric view of an example of a waterproof speaker module.

The description that follows includes sample apparatuses and methods that embody various elements of the present disclosure. However, it should be understood that the described disclosure may be practiced in a variety of forms in addition to those described herein.

The present disclosure discloses apparatuses and methods for waterproof speaker modules. A waterproof speaker module may include a membrane formed from at least one waterproof material, which may be elastic, (such as silicone and/or another elastomer) and a supporting structure. The membrane may include an outer surface, an inner surface, and at least one inwardly-extending region that is indented toward the inner surface (and toward an internal portion of the speaker module). The supporting structure may be coupled to the membrane and include a support structure that mates with the concave region of the membrane when the speaker is subjected to a hydrostatic load. When the speaker is not subjected to a hydrostatic load, at least a portion of the support structure may not contact the concave region.

In this way, the membrane may be resistant to tearing or rupture due to hydrostatic load. Additionally, the supporting structure may support the membrane to prevent tearing or rupture under hydrostatic load but may not interfere with membrane movement when the speaker module is not subject to hydrostatic load.

In some cases, the waterproof speaker module may be incorporated into an electronic device. Such a device may include, but is not limited to, a desktop computer, a wearable device, a laptop computer, a cellular telephone, a personal digital assistant, a mobile computer, a tablet computer, a digital media player, a smart phone, a display device, a television, a kitchen appliance, and/or any other electronic device.

In various implementations, the support structure may be shaped to correspond with a shape of the concave region. For example, the support structure may be curved to correspond to a curve of the concave region.

In some implementations, the speaker module may utilize magnetic flux during operation (though in other implementations the speaker module may utilize other mechanisms for operation such as a piezoelectric speaker mechanism). For example, the speaker module may include a center magnet and a side magnet that are both mounted on a yoke but separated by a gap. The center magnet may polarized to direct magnetic flux upward toward a voice coil that is mechanically bonded to the membrane and the side magnet may be polarized to direct magnetic flux downward toward the yoke. As a result of the magnetic flux, the voice coil may move up and down to cause the membrane to vibrate and produce sound waves. In such an implementation, the supporting structure may be formed of a magnetic material (such as stainless steel) and may aid in the direction of the magnetic flux utilized for speaker module operation.

In such implementations, a lid member may be attached to the top of the center magnet. Such a lid member may be operable to resist downward motion of the membrane and further aid in resistance of the membrane to tearing or rupture when subjected to hydrostatic load.

In one or more implementations, the membrane may include a stiffening structure coupled to at least a portion of the outer surface and/or the inner surface. As the membrane is made of an elastic material, the membrane may not be as sensitive to movement of the voice coil as membranes made of less elastic materials. The stiffening structure may be made of a rigid material (which may be more rigid than the material used to form the membrane) and, as such, may assist in vibration of the membrane. Such a stiffening structure may be dome or other shaped and may be formed of aluminum, a polymer, polyethylene terephthalate (PET), and/or other such rigid material.

In various implementations, the speaker module may include a sealing ring that is coupled to at least a portion of the outer surface of the membrane, a membrane ring that is coupled to at least a portion of the inner surface of the membrane and/or the supporting structure, and/or one or more cover structures that cover one or more parts of the speaker module. In some implementations, the speaker module may include one or more catch mechanisms that are operable to restrict movement of the membrane away from internal portions of the speaker module in order to prevent internal pressure of the speaker module from tearing or rupturing the module.

In one or more implementations, the speaker module may not be hermetically sealed. For example, one or more gaps may be formed in portions of the speaker module. Such gaps may allow internal pressure of the speaker module to be released when the internal pressure of the speaker module exceeds barometric pressure of the environment of the speaker module. When the speaker module is incorporated into another device, such a gap may be positioned on the speaker module so as to not face an external surface of the device. In this way, the gaps may prevent water from entering an interior volume of the speaker, and thus contacting sensitive speaker module components, when the external surface of the device is exposed to water as pressure may escape from the speaker module into an internal portion of the device that is not exposed to water. In other implementations, the gaps may be made too small to admit water but large enough to allow pressure to escape.

Figure 8:
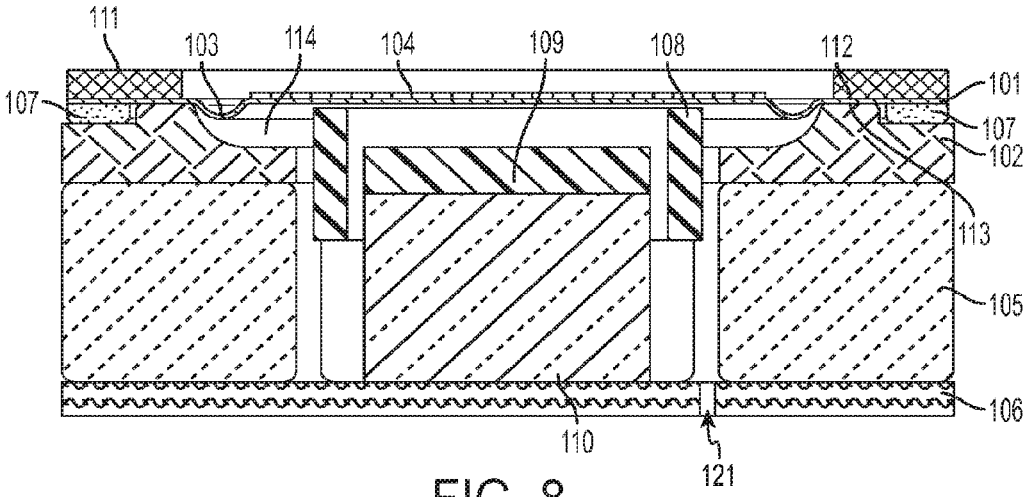
FIG. 8 is a cross-sectional view of an additional embodiment of the waterproof speaker module shown in FIG. 2A.

In implementations where the speaker module is hermetically sealed, the speaker module may include a mechanism for releasing internal pressure of the speaker module when the internal pressure of the speaker module exceeds barometric pressure of the environment of the speaker module. For example, the speaker module may include a one-way barometric pressure valve 121 (shown in FIG. 8) that is operable to release internal pressure of the speaker module but is configured not to allow air, water, or other substances into the speaker module.

Figure 2A:
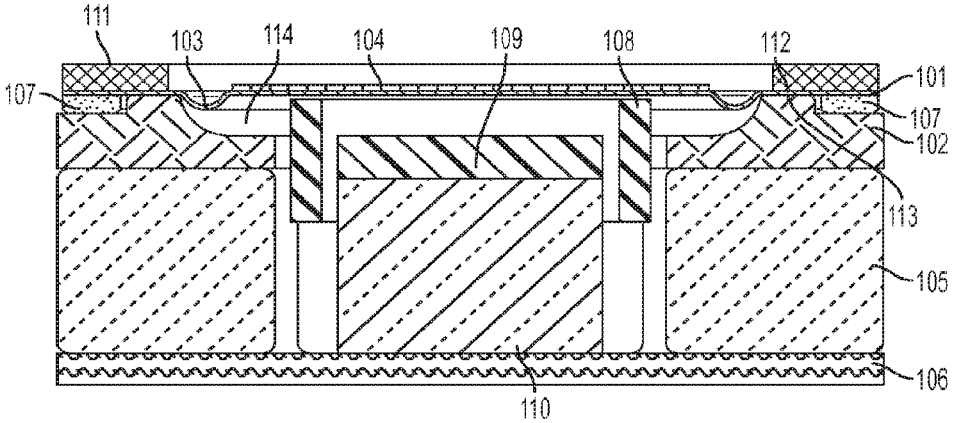
FIG. 2A is a cross-sectional view of the example waterproof speaker module of FIG. 1 taken along the line 2-2 of FIG. 1 in the absence of a hydrostatic load.

FIG. 1 is an isometric view of an example of a waterproof speaker module 100 in the absence of a hydrostatic load. FIG. 2A is a cross-sectional view of the example waterproof speaker module of FIG. 1 taken along line 2-2 of FIG. 1.

As illustrated in FIGS. 1 and 2A, the example waterproof speaker module 100 may include a membrane 101, a supporting structure 114, a stiffening structure 104, a side magnet 105, a yoke (also called a "back plate") 106, a membrane ring 107, a voice coil 108, a top plate 109, a center magnet 110, and/or a sealing ring 111. The membrane may include an inner surface 113, and outer surface 112, and at least one concave region 103. The concave region may be curved toward the inner surface of the membrane. Additionally, the supporting structure may include at least one support structure 114.

In the absence of a hydrostatic load on the example waterproof speaker module 100, the concave region 103 may not contact the support structure 114. However, in the presence of a hydrostatic load on the example waterproof speaker module, the concave region 103 may seal against the support structure 114 and may support the membrane 101, thereby preventing tearing or rupturing of the membrane without interfering with movement of voice coil 108 and/or speaker components during operation. The shape of the concave region of the membrane may also provide strength to the membrane as the membrane including the concave regions is not a single flat plane.

Figure 2B:
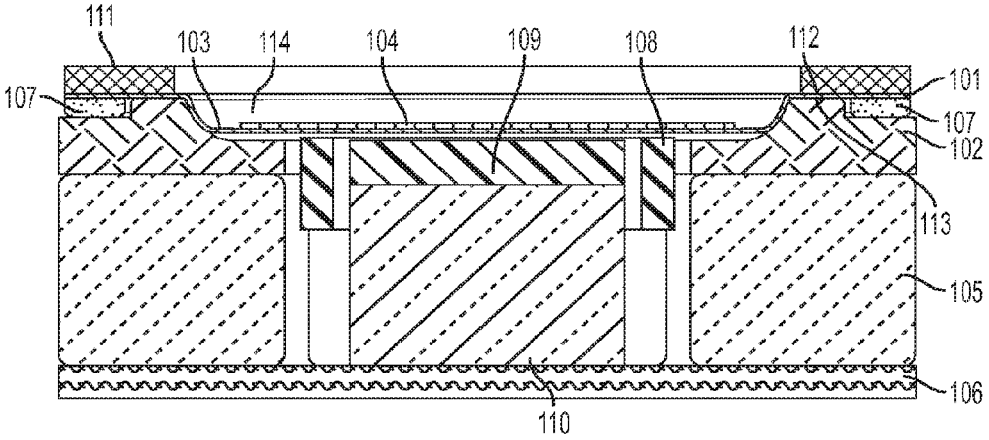
FIG. 2B is a cross-sectional view of the example waterproof speaker module of FIG. 1 taken along the line 2-2 of FIG. 1 in the presence of a hydrostatic load.

FIG. 2B is a cross-sectional view of the example waterproof speaker module of FIG. 1 taken along line 2-2 of FIG. 1 in the presence of a hydrostatic load.

The membrane 101 may be formed of a waterproof and elastic material (e.g., a material able to stretch and return to a pre-stretch shape after stretching). For example, the membrane may be formed of an elastomer, silicone, and/or other elastic and waterproof material. In some cases, the membrane may be chemically bonded to one or more components of the example waterproof speaker module 100, such as the sealing ring 111, the stiffening structure 104, the voice coil 108, the supporting structure 102, the membrane ring 107, and/or other component.

The support structure 114 may be shaped to correspond to the concave region 103. As illustrated, the support structure may be curved to correspond to a curved shape of the concave region. Although the supporting structure 114 may be described and/or shown as "concave" and/or "curved," in some embodiments it may extend inwardly along a relatively straight line and may form an angle, such as a right angle or obtuse angle, with an inner wall or edge of the support structure to form a ledge or indentation. In such embodiments, the membrane (and particularly the concave region 103) may be sufficiently ductile or flexible to enter and/or seal to the angled walls of the supporting structure 114 under a sufficient hydrostatic load.

As illustrated, the example waterproof speaker module 100 may utilize magnetic flux for operation. The center magnet 110 may be electrically controllable to direct magnetic flux toward the voice coil 108 (the top plate 109 and/or the supporting structure 102, each of which may be formed of a magnetic material such as steel or stainless steel, may or may not assist in the direction of magnetic flux) and the side magnet 105 may be electrically controllable to direct magnetic flux away from the voice coil (the yoke 106 and/or the supporting structure 102, each of which may be formed of a magnetic material such as steel or stainless steel, may or may not assist in the direction of magnetic flux). The magnetic flux may cause the voice coil to move up and/or down, thus vibrating the membrane 101 and producing sound waves. As illustrated, the center magnet may be separated from the voice coil by a first gap and the voice coil may be separated from the side magnet by a second gap.

As the membrane 101 may be formed of an elastic material, movement of the voice coil 108 may not induce vibration in the membrane as well as if a membrane formed from other, non-elastic materials were utilized. As such, the stiffening structure (which may be made of a material more rigid than the membrane such as aluminum, a polymer, PET, and/or another such rigid material) 104 may both strengthen the membrane and aid vibration of the membrane caused by movement of the voice coil. The stiffening structure may be domed or otherwise shaped in various implementations.

Although the stiffening structure 104 is illustrated as coupled to the outer surface 112 and the voice coil 108 as mechanically bonded to the inner surface 113, it is understood that this is an example. In various other implementations, the stiffening structure may be coupled to the inner surface of the membrane see FIG. 4) and the voice coil may be mechanically bonded to the stiffening structure.

Returning to FIGS. 1 and 2A, as illustrated, the top plate 109 may also be operable to resist downward motion of the membrane 101, thus potentially supporting the membrane. Further, in implementations where the stiffening structure 104 is coupled to the inner surface 113, the stiffening structure may be wide enough to contact portions of the support structure 114 when the example waterproof speaker module 100 is subjected to a hydrostatic load, thus potentially supporting the membrane in such implementations.

Although the example waterproof speaker module 100 is illustrated as including various magnetic components and utilizing magnetic flux for operation, it is understood that this is an example. In various implementations, the example waterproof speaker module 100 may be a piezoelectric speaker or other kind of speaker without departing from the scope of the present disclosure.

Further, although the example waterproof speaker module 100 is illustrated and described above as including a membrane 101 with concave regions 103, it is understood that such regions. In various embodiments, such regions may be indented such that they extend toward the inner surface 113 with or without being strictly concave. For example, such regions may be indented with 90 degree corners instead of smooth curves without departing from the scope of the present disclosure.

Figure 3:
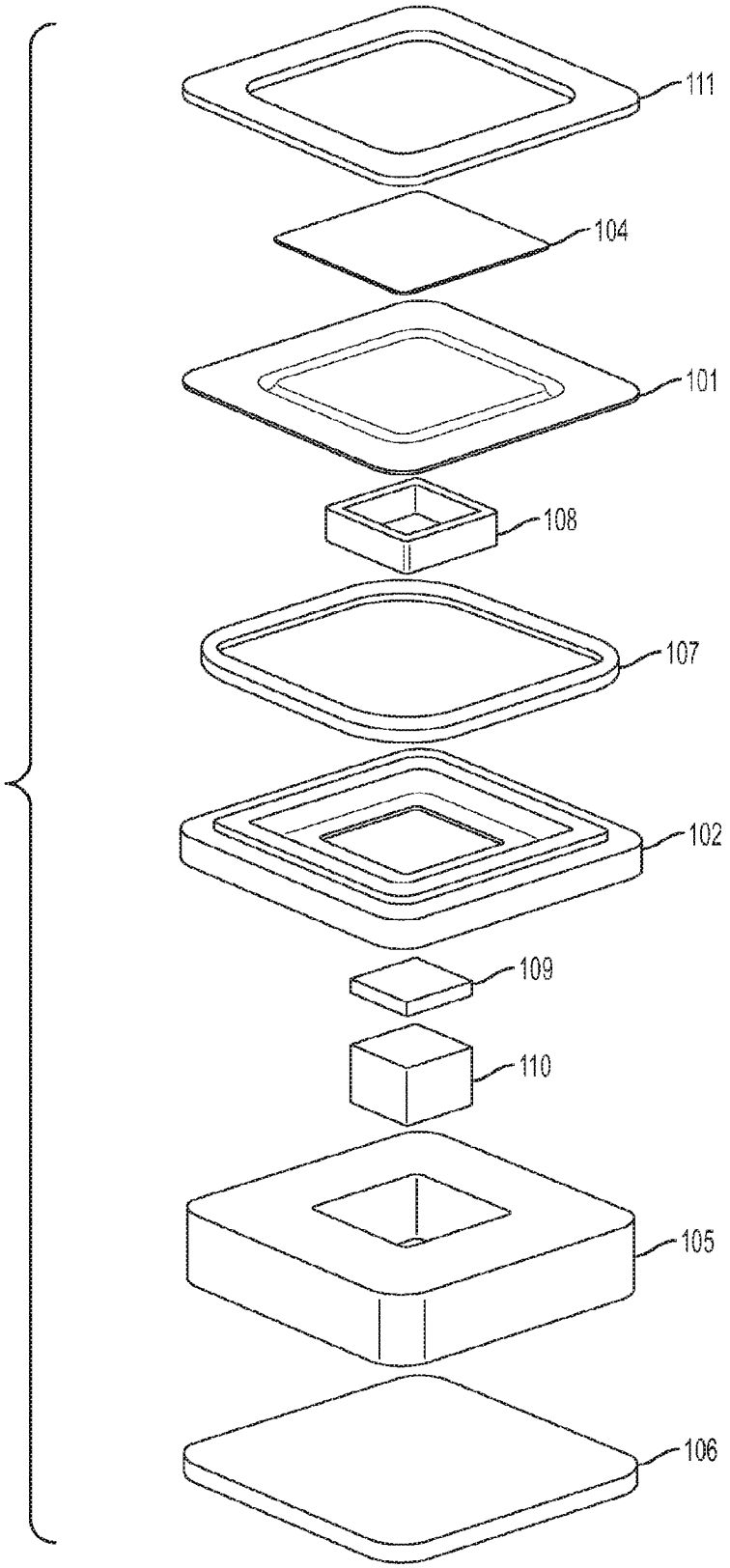
FIG. 3 is an exploded view of the example waterproof speaker module of FIG. 1.

FIG. 3 is an exploded view of the example waterproof speaker module of FIG. 1. As illustrated, the side magnet 105 may be coupled to the yoke 106 and the center magnet 110 may be coupled to the yoke inside a gap of the side magnet. The top plate 109 may be coupled to the top of the center magnet. The supporting structure 102 may be coupled to the top of the side magnet and the membrane ring 107 may be couple to the top of the supporting structure. The voice coil 108 may be mechanically bonded to the inner surface of the membrane 101 and the membrane may be chemically bonded to the top of the supporting structure and the membrane ring. The stiffening structure 104 and the sealing ring 111 may be coupled to the top of the membrane.

Although the example waterproof speaker module 100 is illustrated and described herein as including particular components, in various implementations the example waterproof speaker module may include other components. For example, in various implementations and with respect to FIG. 7, the example waterproof speaker module may include one or more cover and/or lid components 120.

In such implementations, the lid component 120 may restrict outward movement of the membrane in order to prevent rupture or tearing of the membrane potentially caused by internal pressure. Such a lid may include one or more lid support structures that are shaped to correspond with the concave region 103 such that the concave region is operable to seal against the lid support structure when the internal pressure of the example waterproof speaker module exceeds barometric pressure outside the example waterproof speaker module.

Figure 5:
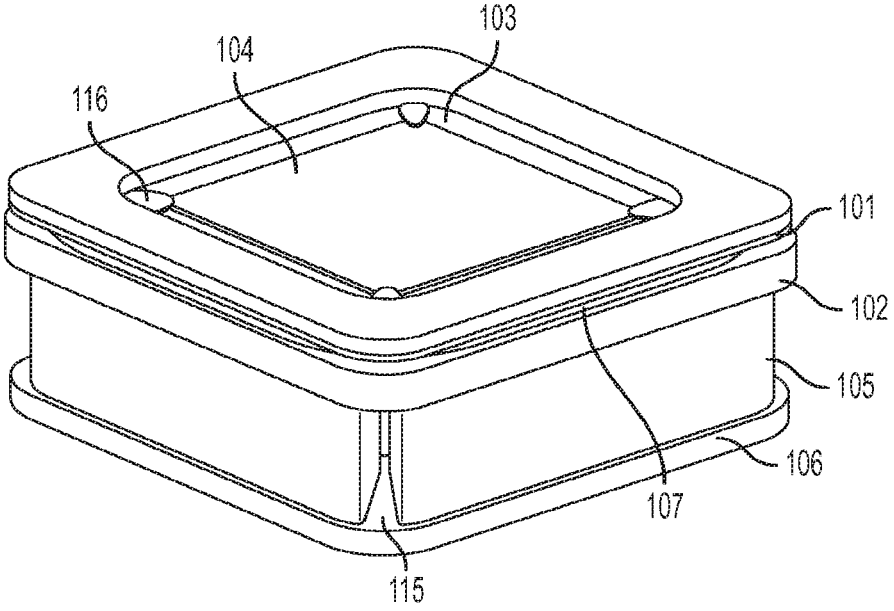
FIG. 5 is an isometric view of an alternative embodiment of the waterproof speaker module shown in FIG. 1.

FIG. 5 is an isometric view of an alternative embodiment of the waterproof speaker module shown in FIG. 1. As illustrated, the side magnet 105 may not be a continuous element and may instead include one or more gaps 115. Such gaps may be positioned at the corners and/or any other portion of the side magnet, for example. In various implementations such gaps may be positioned in components other than the side magnet, such as at or near the yoke 106.

FIG. 5 also illustrates a catch mechanism 116. As illustrated, the catch mechanism 116 has a plurality of prongs 116 coupled to the sealing ring 111 that may be operable to restrict outward movement of the membrane 101 resulting from internal pressure of the example waterproof speaker module 100. However, it is understood that this is an example and in other implementations the catch mechanism may be coupled to other components than the sealing ring and/or take the form of other mechanisms than prongs. For example, in various implementations the catch mechanism may comprise a lid component that covers a top portion of the example waterproof speaker module, which may include one or more holes and/or other gaps to enable passage of sound waves produced by the membrane.

Returning to FIGS. 1 and 2A, the membrane 101 may be formed utilizing compression molding. Such compression molding may create the concave region 103 and/or the shape of the concave region in the membrane. Additionally, the compression molding may form a chemical bond between the membrane and one or more other components, such as the stiffening member 104, the voice coil 108 (in cases where the stiffening member is not coupled to the inner surface 113), the sealing ring 111, the supporting member 102, and/or the membrane ring 107. In cases where the stiffening member is coupled to the inner surface, the voice coil may be bonded to the stiffening member, for example by one or more glues, one or more other adhesives, and/or one or more other attachment mechanisms.

Figure 6:
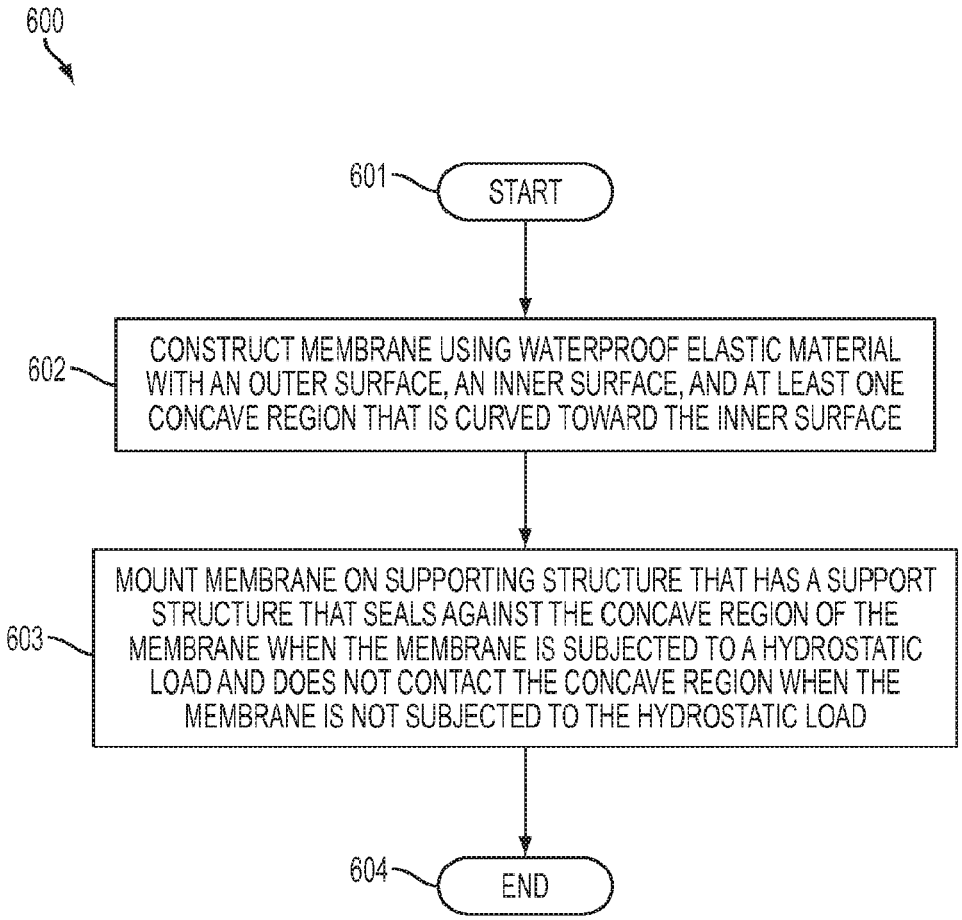
FIG. 6 is a method diagram illustrating an example method for producing a membrane and supporting structure portion of a waterproof speaker module.

FIG. 6 is a method diagram illustrating an example method 600 for producing a membrane and supporting structure portion of a waterproof speaker module. This waterproof speaker module may be any of the example waterproof speaker modules of FIGS. 1-5.

The flow may begin at block 601 and proceed to block 602. At block 602, a membrane is constructed using waterproof and elastic material. The membrane is constructed to have an outer surface, an inner surface, and at least one concave region. The concave region may be concave towards the inner surface. Construction of the membrane may include chemically bonding the membrane to one or more speaker module components.

The flow may then proceed to block 603 where the membrane is mounted to a supporting structure. The supporting structure may include a support structure that is operable to seal against the concave region of the membrane when the membrane and/or the speaker module are subjected to a hydrostatic load. The support structure may not be operable to seal against the concave region of the membrane when the membrane and/or the speaker module are not subjected to a hydrostatic load. The support structure may be shaped to correspond to a shape of the concave region.

The flow may then proceed to block 604 and end.

Although, the method 600 is illustrated and described above as including particular operations performed in a particular order, it is understood that this is an example. In various implementations, various arrangements of the same, similar, and/or different operations are possible without departing from the scope of the present disclosure. For example, in various implementations the method may include additional operations such as chemically bonding a stiffening structure to the membrane and adhesively bonding a voice coil to the stiffening structure.

Figure 4:
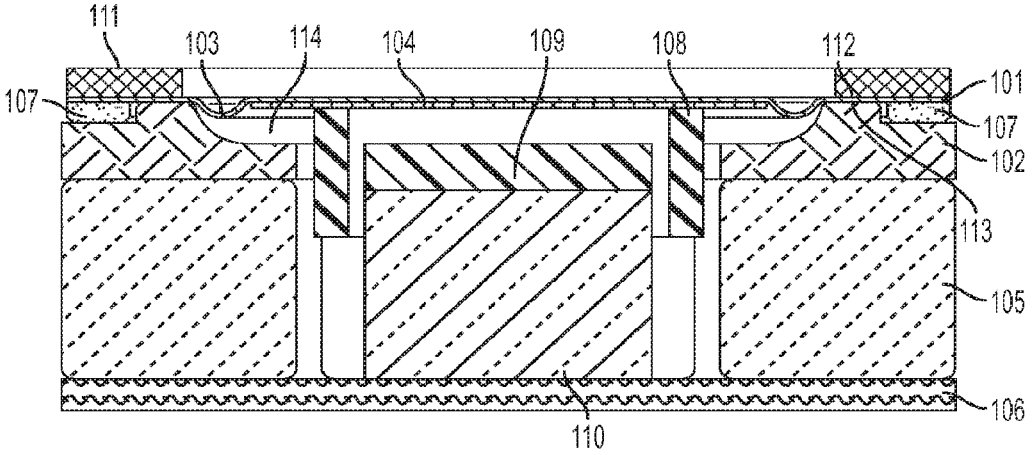
FIG. 4 is a cross-sectional view of an alternative embodiment of the waterproof speaker module shown in FIG. 2A.
Figure 7:
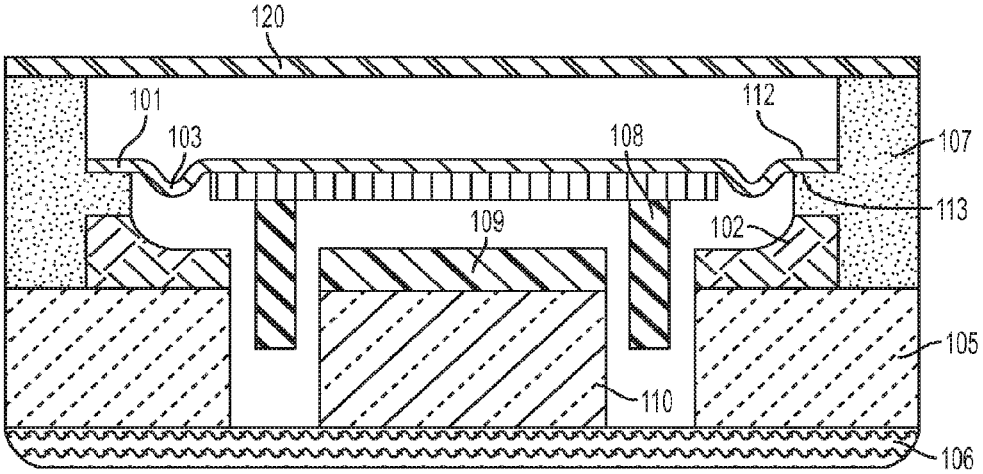
FIG. 7 is a cross-sectional view of an alternative embodiment of the waterproof speaker module shown in FIG. 4.

FIG. 7 is a cross-sectional view of an alternative embodiment of the waterproof speaker module 100 shown in FIG. 4. As illustrated, the speaker module may include a top cover 120 that covers a gap above the membrane 101. Although not illustrated, the top cover may include one or more holes or apertures. Further, the speaker module in this embodiment may not include a stiffening structure or a sealing ring. Additionally, the membrane and the supporting structure 102 may not extend the full width of the speaker module. Instead, as illustrated, the speaker module may be bordered by the membrane ring 107. The membrane and the supporting structure may be attached to the membrane ring within the speaker module and thus be entirely internal to the speaker module. For example, the membrane may be chemically bonded to the membrane ring and/or the voice coil 108.

As discussed above and illustrated in the accompanying figures, the present disclosure discloses apparatuses and methods for waterproof speaker modules. A waterproof speaker module may include a membrane formed from at least one waterproof and elastic material and a supporting structure. The membrane may include an outer surface, an inner surface, and at least one concave region that is curved toward the inner surface. The supporting structure may be coupled to the membrane and include a support structure that mates with the concave region of the membrane when the speaker is subjected to a hydrostatic load. When the speaker is not subjected to a hydrostatic load, the support structure may contact the concave region. In this way, the membrane may be resistant to tearing or rupture due to hydrostatic load. Additionally, the supporting structure may support the membrane to prevent tearing or rupture under hydrostatic load but may not interfere with membrane movement when the speaker module is not subject to hydrostatic load.

In the present disclosure, the methods disclosed may be implemented as operations performed by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. A waterproof speaker module, comprising:

a membrane formed from a waterproof and elastic material and including:

a main region that is generally planar;

a coupling region; and an indented region connecting the main region and the coupling region; and a support coupled to the coupling region of the membrane such that the indented region projects toward the support; wherein:

the support supports the membrane by contacting the indented region when the speaker module is subjected to a hydrostatic load; and the support slopes away from the membrane.

2. The speaker module of claim 1, wherein the support is shaped to correspond to a shape of the indented region.

3. The speaker module of claim 1, wherein the membrane is formed from at least one of silicone or an elastomer.

4. The speaker module of claim 1, wherein the support is formed from steel.

5. The speaker module of claim 1, wherein the support is operable to direct at least one magnetic flux utilized in operation of the speaker module.

6. The speaker module of claim 1, further comprising a stiffening structure coupled to at least a portion of the membrane that assists in vibration of the at least one membrane.

7. The speaker module of claim 6, wherein the stiffening structure comprises at least one of aluminum, a polymer, or polyethylene terephthalate.

8. The speaker module of claim 6, wherein the stiffening structure comprises a rigid material.

9. The speaker module of claim 6, wherein the stiffening structure is dome shaped.

10. The speaker module of claim 1, further comprising a voice coil mechanically bonded to at least a portion of the membrane.

11. The speaker module of claim 10, further comprising:

a center magnet that is operable to direct magnetic flux toward the membrane; and a side magnet that is operable to direct the magnetic flux away from the membrane;

wherein at least a portion of the voice coil is positioned around the center magnet, the voice coil is separated from the center magnet by a first gap, and the voice coil is separated from the side magnet by a second gap.

12. The speaker module of claim 11, further comprising a yoke that is coupled to at least one of the center magnet or the side magnet.

13. The speaker module of claim 11, further comprising a lid member coupled to the center magnet that resists downward motion of the membrane.

14. The speaker module of claim 1, further comprising a sealing ring coupled to at least a portion of the membrane.

15. The speaker module of claim 1, wherein the membrane is chemically bonded to at least one component of the speaker module.

16. The speaker module of claim 1, further comprising a catch mechanism that restrains an amount that the membrane can move.

17. The speaker module of claim 1, further comprising a pressure release mechanism that is operable to release internal pressure of the speaker module.

18. The speaker module of claim 1, wherein the speaker module comprises a piezoelectric speaker module.

19. The speaker module of claim 1, wherein the speaker module is hermetically sealed.

20. The speaker module of claim 1, wherein the support does not contact the indented region when the speaker module is not subjected to the hydrostatic load.

21. A system, comprising: a waterproof speaker module, comprising:

a membrane formed from a waterproof and elastic material and including: at least one outer surface, at least one inner surface, a primary region that is generally planar;

a coupling region; and an indented region connecting the primary region and the coupling region; and that a support coupled to the coupling region of the membrane such that the indented region projects toward the support; wherein:

the support structure supports the membrane by mating with the indented region when the speaker module is subjected to a hydrostatic load; and the support slopes away from the coupling region.

22. A method of operating a speaker module, comprising:

when a speaker module is subject to a hydrostatic load, supporting an indented region of a membrane of the speaker module by sealing against a support that slopes away from the membrane, the membrane including:

a primary region that is generally planar; and an indented region that projects toward the support portion;

and when the speaker module is not subject to the hydrostatic load, not contacting the indented region with the support.

23. The method of claim 22, further comprising subjecting the speaker module to the hydrostatic load.

24. The method of claim 22, further comprising vibrating the membrane utilizing a voice coil.

25. The method of claim 24, wherein said operation of vibrating the membrane utilizing the voice coil vibrates a stiffening structure coupled to the membrane.

26. The method of claim 22, further comprising releasing internal pressure of the speaker module when the speaker module is subjected to the hydrostatic load.

* * * * *